United States Patent [19]

Zeh

[11] Patent Number: 4,623,302

[45] Date of Patent: Nov. 18, 1986

[54] ARRANGEMENT FOR FACILITATING THE START-UP OF NOT SELF-PRIMING CENTRIFUGAL PUMPS

[75] Inventor: Horst Zeh, Eggenstein-Leopoldshafen, Fed. Rep. of Germany

[73] Assignee: Wiederaufbereitungsanlage Karlsruhe Betriebsgesellschaft mbH, Eggenstein-Leopoldshafen, Fed. Rep. of Germany

[21] Appl. No.: 789,943

[22] Filed: Oct. 21, 1985

[30] Foreign Application Priority Data

Nov. 23, 1984 [DE] Fed. Rep. of Germany ..... 3442716

[51] Int. Cl.[4] ..... F04D 9/06

[52] U.S. Cl. ..... 417/89; 417/199 A; 417/203

[58] Field of Search ..... 417/87, 89, 199 A, 203

[56] References Cited

U.S. PATENT DOCUMENTS

| | | | |
|---|---|---|---|
| 869,387 | 10/1907 | Papillon | 417/89 |
| 1,466,413 | 8/1923 | Schaanning | 406/95 |
| 4,067,663 | 1/1978 | Brooks et al. | 417/199 A |

*Primary Examiner*—Richard E. Gluck

[57] ABSTRACT

Arrangement for facilitating the start-up of not self-priming centrifugal pumps for the pumping of radioactive liquids in a nuclear fuel reprocessing plant wherein radioactive liquid is pumped from a first to a second container through the container's top by means of transfer piping which includes a centrifugal pump having its suction side in communication with one container and its discharge side connected to a supply pipe leading to the other container. The supply pipe includes a pressurized air operated jet pump adapted to lift, during start-up, liquid from the container into the centrifugal pump which is then operated to pump the liquid from the one container to the other through the jet pump.

4 Claims, 1 Drawing Figure

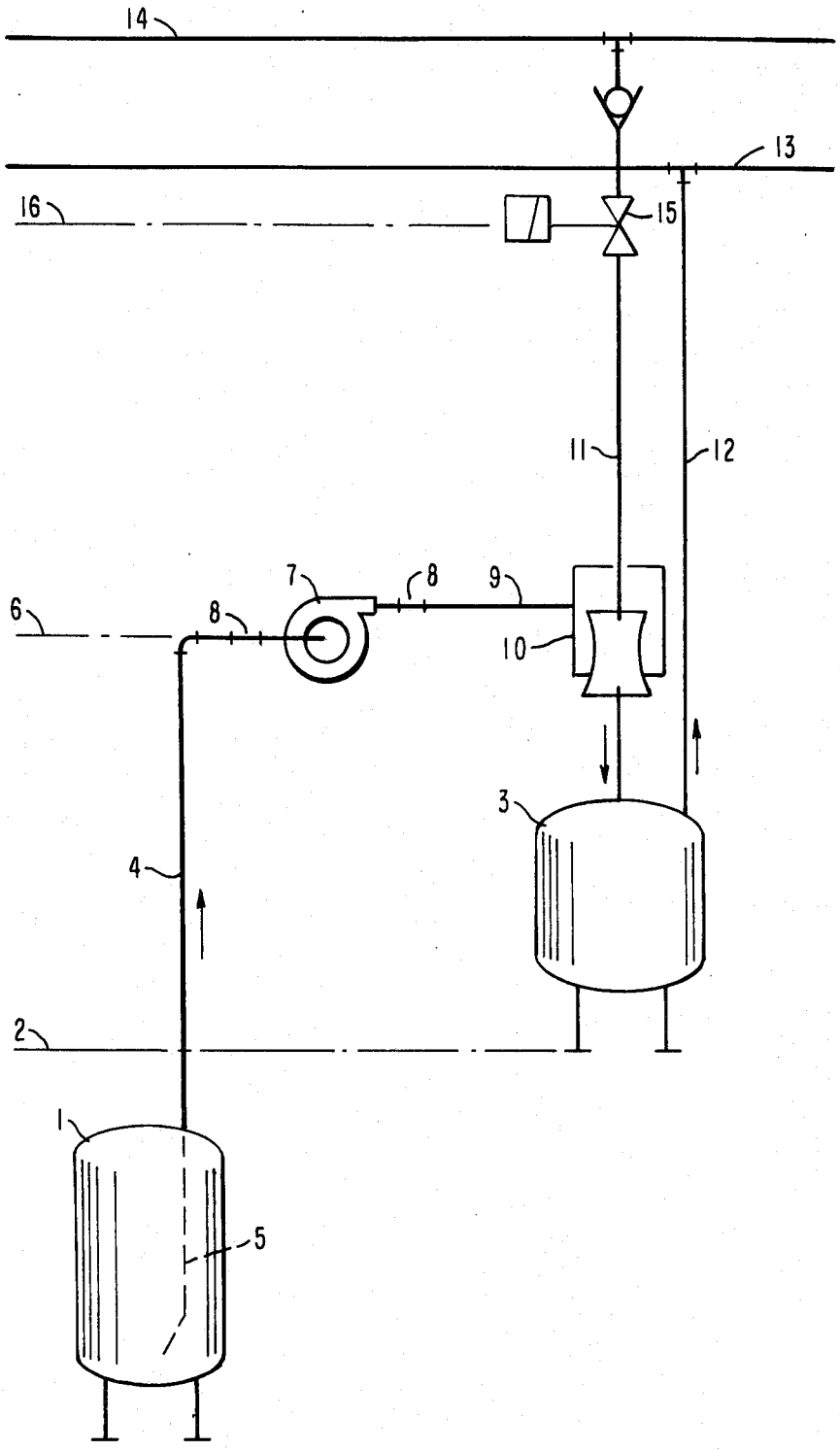
14
13
16
15
11
12
7
8
9
6
8
10
3
4
2
1
5

ARRANGEMENT FOR FACILITATING THE START-UP OF NOT SELF-PRIMING CENTRIFUGAL PUMPS

BACKGROUND OF THE INVENTION

The invention relates to an arrangement for facilitating the start-up of centrifugal pumps which are not self-priming.

Through the use of remotely controlled handling equipment it is possible today to install machinery which requires occasional servicing such as pumps within radioactive areas which are not easily accessible to people. For the transfer of liquids in a nuclear fuel reprocessing plant, single or multiple stage centrifugal pumps are especially suitable because impurities in the liquid do not cause pump failure, the pump space may be so formed and arranged that, after shutdown of the pumping operation, the pump space runs automatically empty.

However, centrifugal pumps are not self-priming.

In a fuel reprocessing plant there are containers which are emptied through their top end (head discharge) in order to safely prevent leakage at the flanges should they become leaky. The centrifugal pumps utilized for the transfer of the liquids therefore need to be able to lift the liquid at least to the height of the containers.

Self-priming pumps are known, but they do require a liquid reservoir and the installation of relatively complicated and sensitive equipment such as valves, additional containers or pumps including liquid reservoir spaces. Such equipment, however, which is subject to failure, is not particularly suitable for use when remote servicing is necessary.

It is the principal object of the invention to provide an arrangement for facilitating the start-up of a not self-priming centrifugal pump which permits flawless operation also be remote control of equipment installed behind shielding walls. Such an arrangement should have no areas in any piping in which liquid can collect and no valves in areas which are accessible only by remotely operated means. High availability, short start-up times and suitability for remote control should also be inherent.

SUMMARY OF THE INVENTION

In an arrangement for facilitating the start-up of not self-priming centrifugal pumps for the pumping of radioactive liquids of a nuclear fuel reprocessing plant from a first to a second container through the container's top ends by means of transfer piping, the transfer piping includes a centrifugal pump having its suction side in communication with the first container and its discharge connected to a supply section of the transfer pipe leading to the second container with a pressurized air operated jet pump disposed in the supply pipe so as to be able to lift, during start-up operation, liquid from the first container into the centrifugal pump which is then operated to pump the liquid from the first container to the second container through the jet pump.

Both pumps are arranged above the containers and the jet pump is arranged at an elevation at least as high as the centrifugal pump with the air supply and discharge lines being disposed above the pumps sufficiently high to prevent liquid from being pumped into the air lines.

With this simple arrangement the centrifugal pump is easily primed and when operated, discharge is simply through the jet pump. By arrangement of the various components at different elevations it is furthermore insured that sensitive components are not contaminated and the contained liquid does not remain in stagnant areas after shutdown.

SHORT DESCRIPTION OF THE DRAWINGS

The sole FIGURE is a schematic representation of the arrangement according to the invention.

DESCRIPTION OF THE PREFERRED EMBODIMENT

As shown in the FIGURE, a collecting container 1 is provided for the reception of radioactive liquids of a nuclear fuel reprocessing plant, which liquids must be pumped to a discharge container 3, disposed at a higher elevation 2. A suction pipe 4 provided with an immersion pipe 5 within the container 1 extends from the collecting container 1 upwardly to a still higher elevation 6 at which there is a centrifugal pump 7 arranged in the pipe 4 by means of flanges 8. The centrifugal pump 7 is so disposed that its inlet is connected to pipe 4 and its outlet to a supply pipe 9 so as to pump from the suction pipe 4 into the supply pipe 9. The supply pipe 9 leads at its end downwwardly to the discharge container 3. Disposed within the supply pipe 9 at the discharge side of the centrifugal pump 7 is a self-priming jet pump 10, which is operated by pressurized air and which is adapted to lift the liquid out of the collecting container 1 and through the centrifugal pump by generating a vacuum in the suction pipe 4. The vacuum generated by the jet pump 10 in the supply pipe 9 is sufficiently high to lift the liquid at least to the level of the centrifugal pump 7. The pressurized air which generates the vacuum in the jet pump 10 is supplied to the jet pump from above through a pressurized air duct 11. The jet pump 10 as shown in the drawing is about at the same elevation as the centrifugal pump 7 itself.

When, upon operation of the jet pump 10, the centrifugal pump 7 is filled with liquid, the centrifugal pump 7 is turned on and the jet pump 10 is turned off. The liquid is then pumped by the centrifugal pump 7 from the collecting container 1 to the discharge container 3 through the jet pump 10.

During start-up operation a certain amount of pressurized air from the pressurized air supply 14 is utilized, which air is discharged by way of discharge container 3 and discharge duct 12 to the discharge line 13. For safety reasons the elevation 16 of the magnetic valve 15, which controls the pressurized air flow in the pressurized air duct 11, is higher than the corresponding pressure head of the centrifugal pump 7 in order to prevent pumping of the liquid into the pressurized air supply 14. Also the elevation of the discharge line 13 is higher than the corresponding pressure head of the pump 7 in order to prevent liquid discharge into the air discharge line 13.

REFERENCE NUMERALS

1: Collecting container
2: Discharge container elevation
3: discharge container
4: Suction pipe
5: Immersion pipe
6: Pump elevation
7: Centrifugal pump
8: Flange

9: Supply pipe
10: Jet pump
11: Pressurized air duct
12: Discharge duct
13: Discharge line
14: Pressurized air supply
15: Magnetic valve
16: Valve elevation

I claim:

1. Arrangement for facilitating startup of a not self-priming centrifugal pump which is disposed above the liquid level of a first container adapted to receive radioactive liquid of a nuclear fuel reprocessing plant for pumping the liquid to a second container, said arrangement comprising liquid transfer piping extending between said first and second containers, said transfer pipe including a centrifugal pump arranged above said containers and having an inlet connected to a suction section of said piping and an outlet connected to a supply section of said piping and a self-priming pressurized air operated jet pump disposed in the supply section of said transfer piping and connected to a pressurized air supply pipe such that said jet pump, upon operation thereof in the start-up phase, is adapted to lift liquid from said first container into and through said centrifugal pump and, in the pumping phase when said centrifugal pump is operated after being primed by said jet pump, the liquid is pumped by the centrifugal pump through said jet pump to said second container, said second container being connected to an air discharge line, both said pressurized air supply pipe and said air discharge line extending at an elevation higher than said pumps, which elevation is not reachable by said radioactive liquid.

2. Arrangement according to claim 1, wherein both said centrifugal pump and said jet pump are arranged at about the same elevation above the first and second containers.

3. Arrangement according to claim 1, wherein the pressurized air supply line includes a magnetically operated air flow control valve and said control valve is arranged at an elevation higher than the pump elevation such that radioactive liquid cannot be pumped up to said control valve.

4. Arrangement according to claim 1, wherein said firt and second containes are arranged at different elevations.

* * * * *